United States Patent [19]

Cetnar

[11] Patent Number: 5,058,870

[45] Date of Patent: Oct. 22, 1991

[54] CLAMPING APPARATUS

[76] Inventor: Raymond P. Cetnar, 32 Stella La., Amsterdam, N.Y. 12010

[21] Appl. No.: 563,422

[22] Filed: Aug. 7, 1990

[51] Int. Cl.[5] ..... B25B 1/00

[52] U.S. Cl. ..... 269/118; 269/147; 269/155

[58] Field of Search ..... 269/126-129, 269/147-149, 155-156, 166-170, 110-111, 118

[56] References Cited

U.S. PATENT DOCUMENTS

| | | | |
|---|---|---|---|
| 886,613 | 5/1908 | Krogh | 269/110 |
| 1,194,666 | 8/1916 | Romanowski . | |
| 1,397,961 | 11/1921 | Holmquist | 269/156 |
| 2,450,967 | 10/1948 | Keiser . | |
| 2,635,656 | 4/1953 | Moore, Jr. . | |
| 3,966,528 | 6/1976 | Christie . | |
| 3,982,740 | 9/1976 | Gutman | 269/155 |
| 4,027,866 | 6/1977 | Ruggiero | 269/121 |
| 4,256,295 | 3/1981 | Egner . | |
| 4,257,584 | 3/1981 | Sterling | 269/167 |
| 4,291,868 | 9/1981 | Giles | 269/167 |
| 4,427,191 | 1/1984 | Hess | 269/128 |
| 4,535,979 | 8/1985 | Paarmann . | |
| 4,671,500 | 6/1987 | Mark | 269/155 |

*Primary Examiner*—Robert C. Watson

*Attorney, Agent, or Firm*—Schmeiser, Morelle & Watts

[57] ABSTRACT

A clamping apparatus is disclosed which can clamp a workpiece in two non-parallel directions. The apparatus is made up of a pipe clamp having an attached adjustable height beam member which spans a significant portion of the pipe clamp's length. The beam member is attached to the pipe clamp by a "U"-bolt shaped retainer at one end and an eye-bolt shaped retainer at the other end. The beam member is sized so that it can be released from the "U"-bolt shaped retainer and thereby be allowed to pivot about the eye-bolt shaped retainer. A modified block structure is also disclosed which can be placed between the beam member and a workpiece being clamped.

15 Claims, 1 Drawing Sheet

CLAMPING APPARATUS

FIELD OF THE INVENTION

The invention is in the field of clamping tools. More particularly, the invention is in the field of woodworking clamps which are capable of applying compressive forces in two nonparallel directions.

BACKGROUND OF THE INVENTION

In the field of woodworking, glue is often employed to permanently join two or more pieces of wood together. The joining process normally comprises three stages: preparation, gluing/clamping and then finally, conditioning.

The preparation stage itself entails a number of different processes. The woodworker must check that the wood surfaces are clean and of the correct shape. To check the latter condition, he or she test fits the joint by assembling the pieces to be joined without the use of glue. Once the worker is satisfied that the joint surfaces are correctly matched, the pieces are again separated and then placed aside. Next, the required glue, clamps and any other needed tools are collected and placed within ready reach. Finally the work surface, a bench top or tabletop, is cleared and cleaned.

The woodworker then begins the gluing/clamping process. Glue is spread with a brush or similar tool onto all of the surfaces that are to be joined. To facilitate the drying process and to increase the strength of the joint, the glue is allowed to slightly dry on the surfaces until it is tacky. The pieces are then joined together and placed onto the work surface. Next, the pieces of wood are carefully aligned to ensure maximum joint strength and proper appearance. Clamps are then applied to the outside of the work to press the different pieces of wood together and to hold them in place. To apply lateral pressure to the workpiece one or more pipe clamps are placed beneath the joined pieces. These clamps are in the form of a length of pipe having a movable, snubable footpiece at one end and a fixed, movable jaw headpiece at the other end. To apply pressure in a normal direction that is perpendicular to the pipe clamp(s), a number of quick clamps are used. These clamps are placed near the sides of the workpiece and bear down on an elongated block of wood that lies atop the upper face of the workpiece. The latter clamp structure is used to eliminate buckling and warping of the pieces of the wood being joined.

The final step is the conditioning process. In this step, both the glue and the wood are allowed to dry. The glue becomes dry in a number of hours. However, the wood itself can take far longer to dry because it absorbs a significant amount of liquid from the glue during the gluing process. As a result, the wood in the region of the joint becomes swollen for an extended period of time. It can require up to a week for the wood adjacent the joint to dry and to return to its former shape. If the glue assembly is surfaced (planed or sanded) before the excess moisture is removed, permanent depressions will later form in the glued region when the wood returns to its unswollen state.

From the preceding, it can be seen that joining two pieces of wood together is a simple and basic process. However, the joining process requires a significant amount of skill and time to perform correctly.

When joining pieces of wood in a side-to-side fashion such as used for butcher blocks or tabletops, a number of different types of glued joints may be used. A plain side-to-side joint mates a flat edge of one piece of wood to a flat edge of an adjacent piece of wood. To increase the amount of surface area that is coated with glue, shaped joints are often employed. These joints include segments that protrude into the interior of one or more of the joined pieces. Mortise-and-tenon and tongued-and-grooved are common examples of the latter type of glued joint.

There is some controversy over which type of joint is the strongest. A satisfactory glued joint is one in which the strength of the joint is approximately equal to or greater than the strength of the wood being glued. Due to their design and greater surface area, shaped joints have a theoretical advantage over the much simpler to make plain side-to-side joints. However, this advantage is often lost due to inexact shaping of the shaped edges involved. An imperfect matching of surfaces causes poor contact between the wood pieces and creates gaps within the joint which adversely affect the strength of the joint.

In choosing the type of joint to be used, a woodworker weighs a number of factors. Firstly, the amount of time to prepare the edges is considered. A shaped edge takes a significantly greater amount of time to form than a flat edge since it is more complex. Secondly, the time and skill required during the gluing/-clamping process is considered. When laying down pieces of wood in side-to-side fashion, the wood often shifts and buckles during the clamping process. A large number of clamps are therefore required to limit this movement and ensure the proper final positioning of the glued pieces. Many woodworkers have found that the use of shaped joints greatly facilitates the clamping process since the joint shape itself tends to maintain the alignment and the position of the wood pieces being joined. This latter factor frequently leads to the woodworker choosing to use a shaped joint in lieu of a plain joint.

Therefore shaped joints, while being more time consuming to manufacture, are often used in lieu of plain side-to-side joints due to the significant time savings realized during the clamping process. There has been a real need in the art for an apparatus that can reduce the time required to clamp a plain side-to-side joint. Such an apparatus would enable a woodworker to use these easier to make joints and still be able to glue and clamp a workpiece in a minimum of time.

SUMMARY OF THE INVENTION

The invention is a clamp structure in which pressure can be quickly and easily applied in two perpendicular directions to the pieces being joined. To apply compressive force in a first direction, the invention employs a common pipe clamp. In combination with the pipe clamp is a second clamping apparatus that can apply compressive force in a second, perpendicular direction. The latter clamp structure is mounted to the ends of the pipe clamp and comprises a rigid beam with variable height mounts at each end. The mounts are connected at their respective bases to the ends of the pipe clamp and are movable thereon.

An elongated member such as a long wooden block may be placed between the movable beam and the workpiece to enable the clamp to apply pressure uniformly along the surface of the workpiece. Alternatively, one or more small fiberglass faced wooden blocks may be selectively placed between the beam and the workpiece to apply pressure only in the region of the joint(s) or in areas that are warped or bowed. Fiberglass or a similar plastic material is used on the face of each small block and optionally on the long block to prevent any adherence between the block and the glued workpiece.

The invention enables a woodworker to rapidly align and level a plurality of wood pieces that are to be joined together. The movable beam can be pivoted into a non-operative position to facilitate the initial placement of the wood pieces. Once the beam is moved into its operative position, it can be used to apply pressure over the entire surface of the workpiece or in localized areas as needed. The combined clamps allow the woodworker to rapidly apply compressive forces on the workpiece in the two axes normally required. The invention can be quickly disassembled after use for easy storage. The invention is also inexpensive to manufacture.

DETAILED DESCRIPTION OF THE INVENTION

Figure 1:
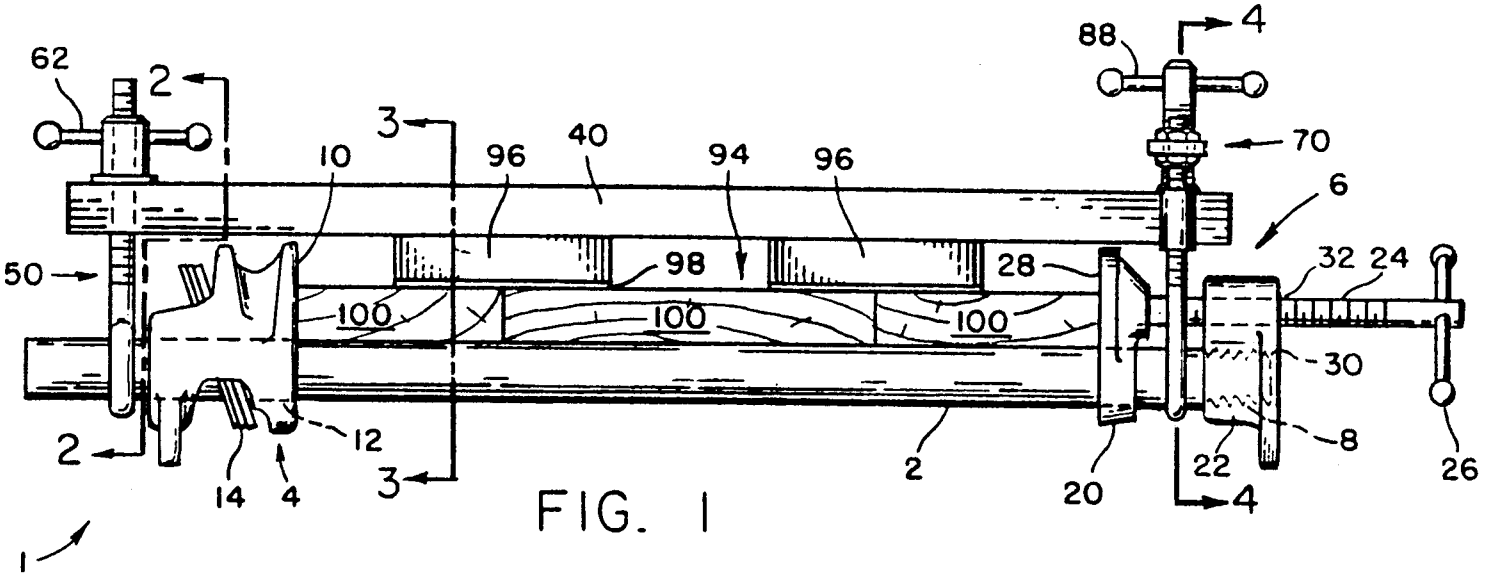
FIG. 1 shows a front view of the invention being used to clamp a plurality of wooden members.

Referring now to the drawings in greater detail, wherein like reference characters refer to like parts throughout the several figures, there is shown by the numeral 1 a wood clamping assembly. The assembly includes a first direction clamp in combination with a second direction clamp.

The first direction clamp is composed of a standard type pipe clamp that has a body made from a length of pipe 2. A footpiece 4 and a headpiece 6 are located near opposite ends of the pipe in the conventional manner. The pipe is preferably hollow and includes an exterior threaded end 8.

The footpiece 4 has a flat inner face 10 and includes a circular through-bore 12 of a diameter greater than that of the pipe which extends therethrough. A plurality of angled engagement plates 14 are retained within the footpiece and each includes an aperture aligned with the through-bore and through which the pipe also passes. A spring (not shown) is located within the footpiece and urges the engagement plates toward an angled position. This causes the plates to engage with and bind onto the pipe thereby preventing movement of the footpiece along the pipe. To move the footpiece, a woodworker applies pressure on an outer end of the plates in a direction opposite the spring force. This causes the plates toward a vertical position thereby eliminating their binding engagement of the pipe and freeing the footpiece to move along the pipe.

The head piece 6 includes a movable jaw portion 20 and a fixed portion 22. A threaded connector/screw 24 is used to connect the two portions and includes an outer handle 26 at one end. The movable portion 20 includes a bore (not shown) which rotatably receives the inner end of the threaded connector. A lock screw (not shown) prevents the connector from pulling out of the bore. The movable jaw portion has a flat face 28 and a bottom through-bore which slidably encircles the associated pipe portion. The fixed portion of the headpiece has a bore 30 that is threadedly engaged to the threaded end 8 of the pipe. A second threaded hole 32 is located at the top of the fixed portion which encircles and threadedly engages the outer end of the connector 24 interior to the handle 26. Therefore, rotation of the threaded connector 24 by turning the handle will have the effect of moving the headpiece's movable portion 20 relative to its fixed portion.

The second direction clamp is composed of a rigid beam 40 which is removably attached to the pipe clamp by a swivel retainer 50 at one end and a releasable retainer 70 at its other end. The clamp adjusts by varying the spacing between the beam and the pipe clamp.

Figure 2:
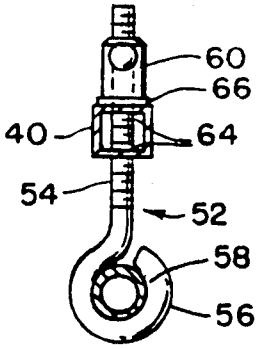
FIG. 2 is a cross-sectional view of the assembly of FIG. 1 taken at a point between the eye-bolt and the footpiece of the pipe clamp.

The swivel retainer 50 includes an eye-bolt 52 that has a threaded stem 54 and a circular head 56. The head includes an interior opening 58 that is larger in diameter than the pipe. Located on the stem is an internally threaded nut 60 that includes a handle 62 at its topmost portion. As can be seen in FIG. 2, the stem passes through an aperture 64 in the beam 40 and a washer 66 is sandwiched between the top of the beam and the bottom surface of the nut 60.

Figure 4:
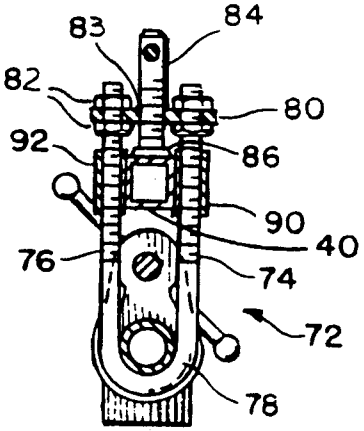
FIG. 4 is a cross-sectional view of the assembly of FIG. 1 taken at the U-bolt portion of the clamp.
Figure 3:
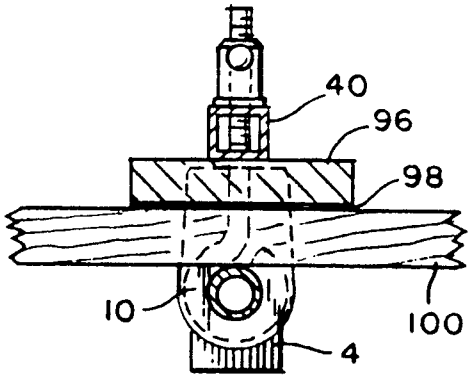
FIG. 3 is a cross-sectional view of the assembly of FIG. 1 taken at an interior point between the headpiece and footpiece of the pipe clamp.

The releasable retainer 70 includes a U-bolt portion 72 that has two threaded legs 74, 76 and a "U"-shaped connecting portion or head 78. The connecting portion has a curvature which matches the exterior surface of the bottom half of the pipe 2. The "U"-bolt portion of the retainer is located between the fixed and moving portions of the pipe clamp's head piece 6. As can be seen in FIG. 4, the top of the "U"-bolt includes a clamp head 80 which is locked onto the legs of the "U"-bolt by two pairs of locknuts 82. At the center of the clamp head 80 is an internally threaded aperture 83 through which an externally threaded screw member 84 passes. The screw member includes a rotatable head 86 at one end and a handle 88 at its other end. The threads of the screw member engage the internal threads of the aperture and in this manner, rotation of the screw member causes the screw to move in a direction parallel to the longitudinal axis of each of the "U"-bolt's legs.

As can also be seen in FIG. 4, one end of the beam 40 passes between the legs of the "U"-bolt. The rotatable head 86 of the screw member contacts the top surface of the beam so that downward travel of the screw member pushes the end of the beam downwards. To maintain the proper positioning of the beam within the "U"-bolt, a pair of cylindrical nylon bushings 90, 92 are used. One bushing is placed on each of the legs of the "U"-bolt in an area adjacent the beam.

As can be seen in FIG. 1, the beam 40 extends only a short distance past the releasable retainer 70. The retainer is so named because if the screw member is sufficiently retracted away from the beam, the retainer can be manually angled in an outward direction so that the head 86 swings beyond the end of the beam. This allows the beam to be released from the retainer and to then swivel about the stem 54 of the swivel retainer.

When clamping a workpiece below the beam, at least one block of wood (or a similar material) is placed between the beam 40 and the workpiece 94. FIG. 1 shows two wooden blocks 96 so placed. Each wooden block includes a plastic face 98 that is made from a fiberglass or plexi-glass type material. The plastic material is bonded to the block and is used to prevent glue from the joint of the workpiece from bonding to the wooden block. The number of blocks used, their size and location of placement are all dependent on the workpiece being glued. If pressure is to be exerted only in the area of the joint(s) or in small warped or bowed areas, one or more small blocks would be used. If pressure is to be evenly exerted along the entire top of the workpiece, a single long block would be used.

To set up the clamp assembly, the following steps are taken:

First, the clamp is placed in its "open" position. This entails opening the pipe clamp portion so that the space between its fixed and movable jaws is slightly greater than the side-to-side distance of the workpiece to be clamped. The second direction clamp is placed into its "open" position by first adjusting the releasable retainer 70 to its fully open position and then angling its top toward the outer end of the pipe. This causes it to disengage from the end of the beam. The beam is then pivoted about the swivel retainer 50 until it is in a position perpendicular to the pipe 2. It is able to pivot since the stem 54 of the eye-bolt 52 passes through a single aperture in the beam thus allowing the beam to pivot about the stem 54.

The next step involves the placement of the workpiece within the clamp. For the workpiece shown in FIG. 1, three pieces of wood 100 are to be glued in side-to-side fashion. The three pieces are placed atop the pipe clamp between its headpiece 6 and foot piece 4. The handle 26 of the headpiece is turned until the workpiece is snugged between the two jaws of the clamp. Next, the second direction clamp is engaged by pivoting the beam ninety degrees and then catching its end under the rotatable head 86 of the releasable retainer. The wooden block(s) 96 are then placed between the beam and the workpiece. For the example shown in FIG. 1, two blocks are so positioned. Next, the two handles 62 and 88 associated with retainers 50 and 70 respectively are then turned until the beam snugs down the workpiece.

The last step involves snugging down both clamps (by appropriate turning of handles 26, 62 and 88) until the workpiece is under the desired final compressive pressure.

To later remove the glued workpiece from the clamping apparatus, the procedure is reversed.

It should be noted that the swivel retainer 50 can be replaced with a releasable type retainer if a pivoting action is not desired.

The embodiment disclosed herein has been discussed for the purpose of familiarizing the reader with the novel aspects of the invention. Although a preferred embodiment of the invention has been shown and described, many changes, modifications and substitutions may be made by one having ordinary skill in the art without necessarily departing from the spirit and scope of the invention.

I claim:

1. A clamping apparatus comprising:

a first clamping means having a first end portion, a second end portion, a body portion and two clamping jaws mounted on said body portion wherein a workpiece can be clamped between said jaws and thereby experience a compressive force in a first direction;

a second clamping means having a beam member and two adjustable attachment means located at first and second end portions thereof which attach said beam member to the first and second end portions of said first clamping means wherein adjustment of said attachment means causes said beam member to move in a direction which can cause a workpiece located between itself and said first clamping means to be compressed in a second direction nonparallel to said first direction and;

wherein each of said first and second clamping means is independently operable.

2. The apparatus of claim 1 wherein said first clamping means is a pipe clamp comprising a pipe, a headpiece having a first jaw means and a tailpiece having a second jaw means wherein said headpiece is fixedly mounted on said pipe and said tailpiece is slidably mounted on said pipe and includes fixing means for releasably securing it to said pipe anywhere along the length of said pipe.

3. The apparatus of claim 2 wherein one of said adjustable attachment means comprises a "U"-shaped member which encircles at least a portion of the perimeter of a segment of said pipe.

4. The apparatus of claim 1 wherein one of said adjustable attachment means includes a pivot means whereby one end of said beam member can be released from the other of said adjustable attachment means and pivot about a portion of the adjustable attachment means that includes a pivot means.

5. The apparatus of claim 1 further comprising at least one removable rigid block member wherein when a workpiece is being clamped by said clamping apparatus, said at least one rigid block member can be placed between the beam member and the workpiece being clamped.

6. The apparatus of claim 5 wherein said at least one block member has a plastic panel located on at least one side thereof.

7. The apparatus of claim 6 wherein said plastic panel is made from a fiberglass material.

8. A multi-axis clamping apparatus comprising:

a pipe member having a first end and a second end;

a first jaw member adjustably secured to said pipe member;

a second jaw member removably attached by fastening means to one of said ends of said pipe member;

a jaw adjusting means attached to said second jaw member which is operable to move an attached jaw means along said pipe member relative to a nonmoving portion of said second jaw member;

a first retainer means located on said pipe member proximate said first end of said pipe member;

a second retainer means located on said pipe member proximate said second end of said pipe member; and a beam member secured at each end by said first and second retainer means and spacedly located adjacent said pipe member wherein each of said retainer means includes means for adjusting the spacing between said beam member and said pipe member thereby allowing the beam member to be moved relative to said pipe member independently of any movement of said first or second jaw members.

9. The apparatus of claim 8 wherein said first retainer means includes means for disengaging it from one end of said beam member and upon disengagement, allowing said beam member to be retained by only said second retainer means.

10. The apparatus of claim 9 wherein said second retainer means is attached to an end of said beam member by means which allows said beam member to pivot about a portion of said second retainer means when said beam member is disengaged from said first retainer means wherein said second retainer means has a longitudinal axis perpendicular to a longitudinal axis of said pipe member and wherein when said beam member pivots about said second retainer means, it remains substantially perpendicular to the longitudinal axis of said second retainer means.

11. The apparatus of claim 8 further comprising at least one removable block member wherein when a workpiece is located in said clamping apparatus between said jaw members, said block member can be placed between a bottom surface of said beam member and a surface of said workpiece.

12. The apparatus of claim 11 wherein said block member has at least one side covered with a nonadherence material that does not readily adhere to common woodworking glue.

13. The apparatus of claim 12 wherein said nonadherence material is fiberglass.

14. A clamping apparatus comprising:

a first clamping means having a first end portion, a second end portion, a body portion and two clamping jaws mounted on said body portion wherein a workpiece can be clamped between said jaws and thereby experience a compressive force in a first direction;

a second clamping means having a beam member and two adjustable attachment means located at first and second end portions thereof which attach said beam member to the first and second end portions of said first clamping means wherein adjustment of said attachment means causes said beam member to move in a direction which can cause a workpiece located between itself and said first clamping means to be compressed in a second direction nonparallel to said first direction;

wherein said first clamping means is a pipe clamp comprising a pipe, a headpiece having a first jaw means mounted on said pipe and a tailpiece having a second jaw means also mounted on said pipe;

wherein one of said adjustable attachment means comprises a "U"-shaped member which encircles at least a portion of the perimeter of a segment of said pipe; and wherein the other of said adjustable attachment means comprises an eyebolt shaped member having a circular portion that includes a circular aperture which encircles a segment of said pipe.

15. The apparatus of claim 14 wherein said beam member includes an aperture at one end through which an elongated stem portion of said eyebolt shaped member extends and wherein said beam can be made to pivot about said stem portion.

* * * * *